United States Patent [19]

Fontana

[11] 4,358,005

[45] Nov. 9, 1982

[54] SUIT-CASE ON WHEELS WITH AN INCORPORATED DRAGGING DEVICE

[75] Inventor: Giampiero Fontana, Milan, Italy

[73] Assignee: Valextra S.p.A., Milan, Italy

[21] Appl. No.: 204,274

[22] Filed: Nov. 5, 1980

[30] Foreign Application Priority Data

Mar. 21, 1980 [IT] Italy ..... 21258/80[U]

[51] Int. Cl.[3] ..... A45C 5/14

[52] U.S. Cl. ..... 190/18 A; 190/58 B

[58] Field of Search ..... 190/18 A, 58 B; 280/37, 280/47.37 R

[56] References Cited

U.S. PATENT DOCUMENTS

| | | | |
|---|---|---|---|
| 1,582,045 | 4/1926 | Howe | 280/47.37 R |
| 3,799,568 | 3/1974 | Hager | 190/18 A X |
| 3,805,929 | 4/1974 | Kuwayama | 190/18 A |
| 3,917,038 | 11/1975 | Foge et al. | 190/18 A |
| 3,948,365 | 4/1976 | Gregg et al. | 190/18 A |
| 4,256,320 | 3/1981 | Hager | 190/18 A X |

*Primary Examiner*—Donald F. Norton

*Attorney, Agent, or Firm*—Stevens, Davis, Miller & Mosher

[57] ABSTRACT

The invention relates to a suit-case on wheels with an incorporated dragging device, of the type comprising a grippable handle connected in an articulated manner to the suit-case body which is composed of two half-shells, wherein said handle is housed hidden in an extractable manner in a seat disposed in the roof zone of one of said half-shells, and is pivoted to a slider which is slidably guided in said seat.

2 Claims, 5 Drawing Figures

SUIT-CASE ON WHEELS WITH AN INCORPORATED DRAGGING DEVICE

Suit-cases are available which are slidable on wheels and are provided with a device which enables them to be more or less easily dragged along the ground.

These dragging devices are mainly of two types.

A first type comprises a sort of handle which is hinged at one end to one side of the suit-case so that it can be moved between two positions, namely a first non-operational position in which the handle is disposed vertically against the side of the suit-case, and a second operational position, substantially at 90° to the first, in which the handle is rotated horizontally so that it can be gripped in order to drag the suit-case. In this case, the suit-case is dragged standing only on the two wheels opposite the handle, in a position inclined towards the carrier who proceeds in an erect position. This is because the height of the suit-case is never sufficient to reach the hand of the user, who holds his appropriate arm extended along his side.

A second type of dragging device comprises a large handle mounted against one wall of the suit-case in a manner mobile between two positions, namely a first non-operational withdrawn position in which the handle is contained within the overall dimensions of the case, and a second operational position in which it is extracted so that it projects from one side of the suit-case to be gripped for dragging the suit-case. In this case, the suit-case is dragged with its load bearing on the wall provided with the handle, on two wheels opposite this latter and inclined towards the carrier. Both the dragging devices heretofore described suffer from the same drawbacks, namely that they negatively influence the appearance of the suit-case, and always require a certain physical force for transportation, because the suit-case must always be partly lifted from the ground.

The object of the present invention is to obviate the aforesaid drawbacks, and this object is attained according to the invention by a suit-case on wheels with an incorporated dragging device, of the type comprising a grippable handle connected in an articulated manner to the suit-case body which is composed of two half-shells, wherein said handle is housed hidden in an extractable manner in a seat disposed in the roof zone of one of said half-shells, and is pivoted to a slider which is slidably guided in said seat.

Preferably, said slider is provided with means for its snap-connection to a control knob housed at that end of said seat distant from the end from which said handle is extracted, said knob being also provided with actuator means arranged to release said snap-connection with the slider.

The structural and operational characteristics of the invention and its advantages over the known art will be more apparent from an examination of the description given hereinafter by way of example with reference to the accompanying drawings, in which.

Figure 1:
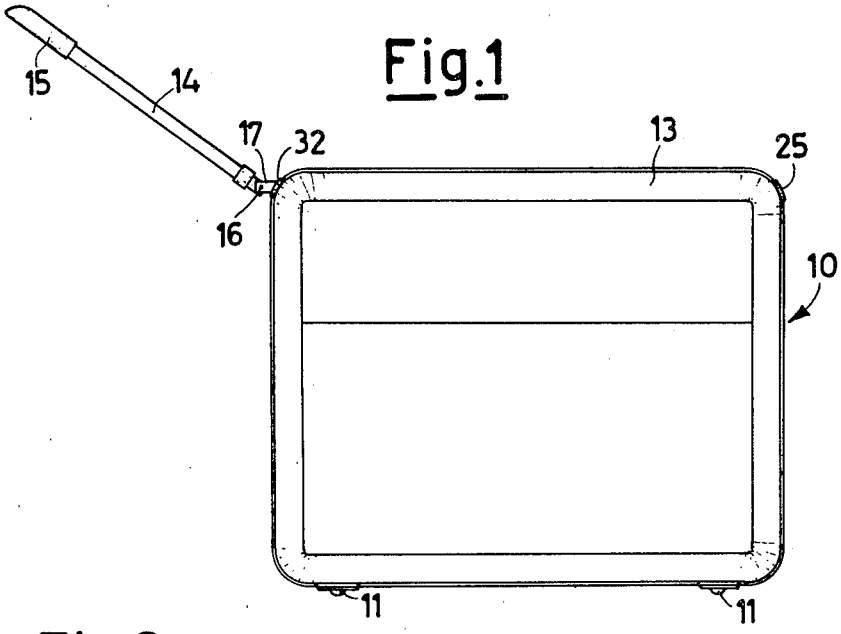
FIG. 1 is a diagrammatic elevational view illustrating a suit-case fitted with a dragging device according to the invention, in the operating position.
Figure 3:
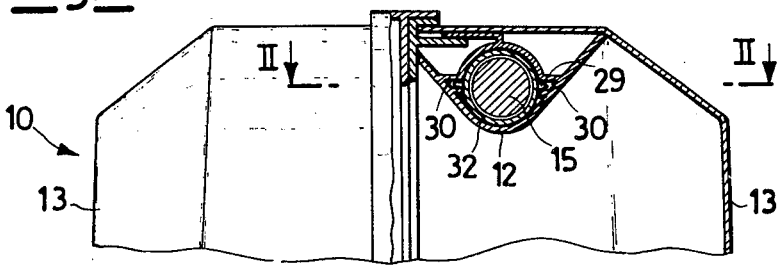
FIG. 3 is a section on the line III—III of FIG. 2.

With reference to the drawings, the suit-case according to the invention is indicated overall by 10, and is of the type provided with four slide wheels 11.

According to the present invention, the suit-case 10 is provided with a dragging device of the hidden type which, when in its non-operational position is completely contained in a tubular seat 12 mounted in the roof of one of the two half-shells 13 which make up the suit-case.

The dragging device according to the invention comprises a cylindrical handle 14 with a grip 15. At the end distant from 15, the handle 14 is pivoted by a pin 16 to a terminal fork 17 of a slider 18. At the end distant from 17, the slider 18 is provided with an axial stem composed of three resiliently yieldable tongues 19, each terminating in a retention tooth 20. The teeth 20 are bevelled at 21, and are arranged to snap-engage in an annular undercut 22 of a socket 23 forming part of an operating knob 24 slidable in a fixed bush 25. The socket 23 is mobile on a tubular extension 26 of the knob 24 against the action of a spring 27 which acts between the knob and the socket.

A spring 28, more powerful than the spring 27, acts between the socket 23 and the slider 18.

A pair of diametrically opposing pins 29, engaged between guides 30 of the seat 12, ensure the correct sliding of the slider 18 and its required angular positioning. The pins 31 on the knob 24 serve the same purpose.

In addition, a bush 32, equal and opposite to the bush 25, provides for the guided exit of the grip 15 from the seat 12. The operation of the dragging device according to the invention is apparent from the aforegoing description, and briefly takes place in the following manner.

Figure 5:
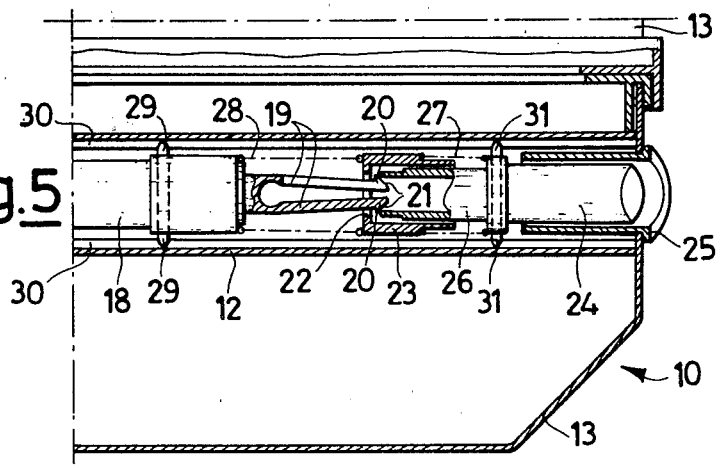
FIG. 5 is a detail.
Figure 2:
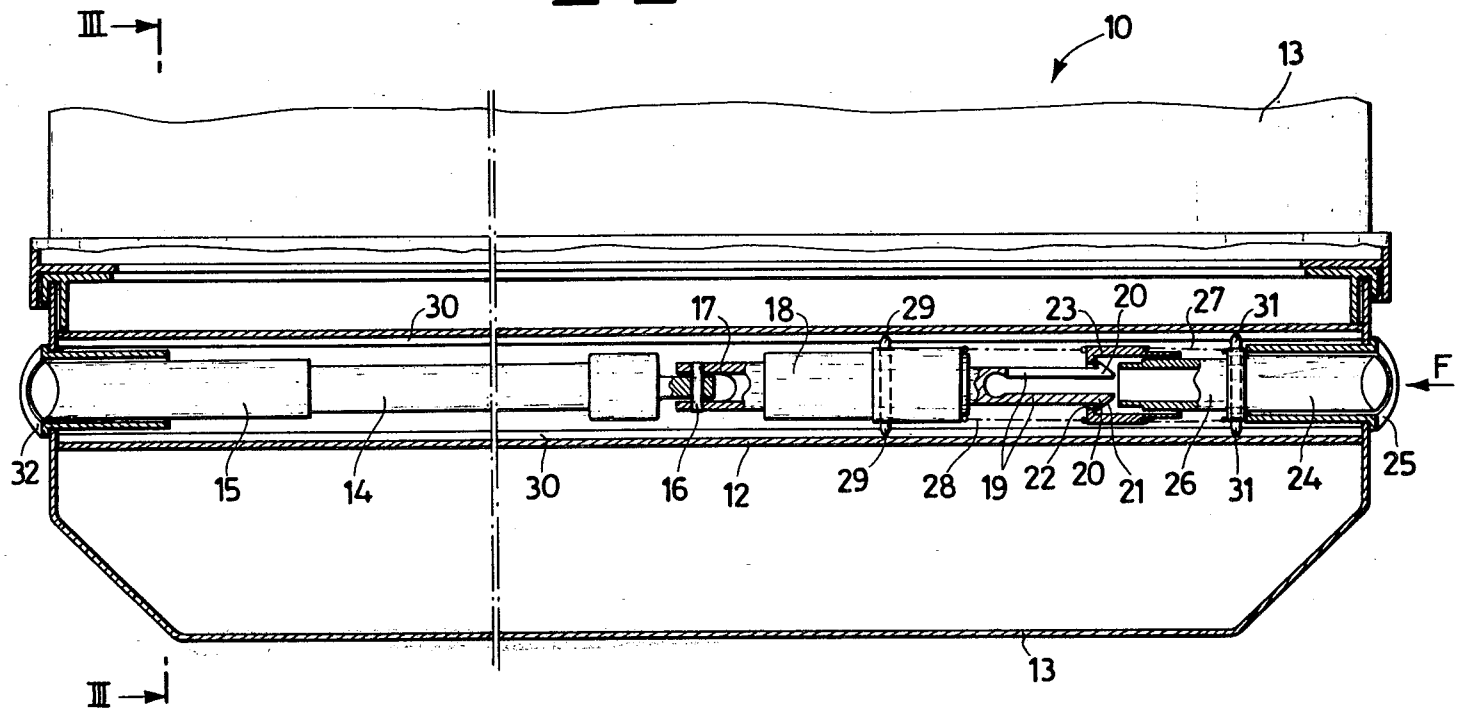
FIG. 2 is an enlarged view illustrating said dragging device in section on the line II—II of FIG. 3 in the rest position.
Figure 4:
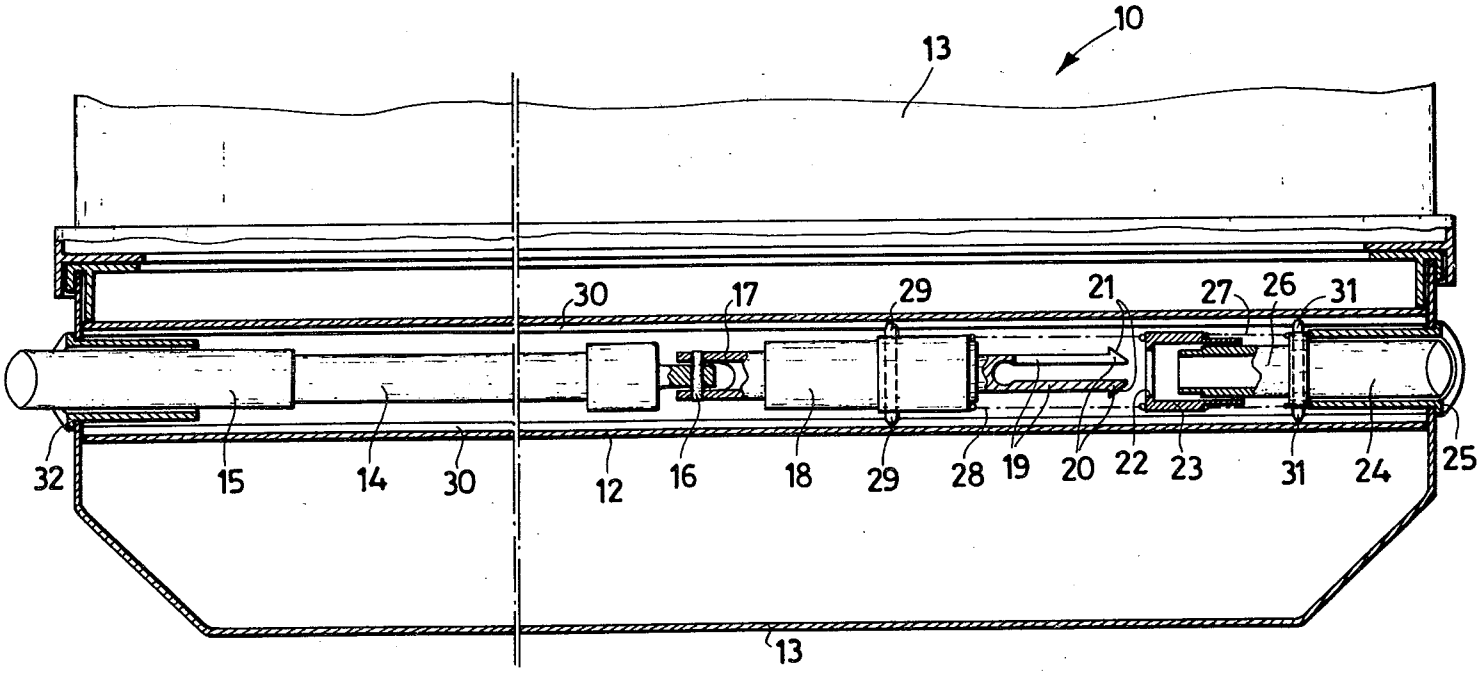
FIG. 4 is a view similar to that of FIG. 2, but illustrating the dragging device in an extracted position ready for use.

When it is required to extract the grip 15 from the position shown in FIG. 2 and move it into the position shown in FIG. 1, it is only necessary to push the knob 24 in the direction of the arrow F (FIG. 2) until the extension 26 presses the resilient teeth inwards (FIG. 5) so that they disengage from the undercut 22. Consequently, the spring 28, which is more powerful than the spring 27, pushes the slider 18 and the handle 14 into the position of FIG. 4, in which the grip 15 emerges from the body of the suit-case so that it can be gripped and completely extracted into the position of FIG. 1. It is apparent that when the grip 15 is in this position, it can be rotated well above the suit-case by virtue of the pivot 16, so that it can be comfortably gripped by the user without lifting the suit-case, which can be dragged along the ground on all four wheels, and thus with the minimum effort.

The handle 14 can be returned to the position of FIG. 2 by inserting it into the seat 12 until the teeth 20 are caused to snap-engage in the undercut 22 of the socket 23.

A dragging device of the hidden type is thus provided which in no way detracts from the appearance of the suit-case, and which at the same time enables it to be comfortably transported on four wheels, i.e. without any need for partial lifting of the suit-case.

I claim:

1. A suit-case on wheels comprising two half-shells, wheels attached to a side of said suit-case, one half-shell defining an enclosed seat extending the length of a side opposite the wheels, a slider slidably guided in said seat, a grippable handle articulated to said slider and housable within said seat in an extractable manner, said articulation extending beyond said seat when said handle is extracted, a snap-connector attached to said slider, a control knob housed at an end of said seat distant from the end from which said handle is extracted to which said snap-connector is snapp-connectable and an extension provided on said control knob arranged to release said snap-connector with said slider.

2. The suit-case as claimed in claim 1, wherein said control knob includes a socket having an annular undercut, said knob having a tubular extension upon which said socket is slidable, said snap-connector comprising a plurality of resiliently yieldable tongues extending axially from said slider and each terminating in a retension tooth snap-engageable with the annular undercut of said socket, said extension being arranged to act on said teeth in the sense of releasing them from said undercut, a spring between said knob and said socket and a spring between said socket and said slider said spring between said knob and said socket being less powerful than the spring between said socket and said slider.

* * * * *